US006352323B1

(12) United States Patent
Rives

(10) Patent No.: US 6,352,323 B1
(45) **Date of Patent: *Mar. 5, 2002**

(54) MEDIA PRESENTATION SYSTEM

(75) Inventor: Eric Charles Rives, Wyoming, MI (US)

(73) Assignee: Steelcase Development Corporation, Caledonia, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/224,900

(22) Filed: Dec. 31, 1998

(51) Int. Cl.[7] ..... A47B 88/00
(52) U.S. Cl. ..... 312/324; 312/223.3; 52/36.1
(58) Field of Search ..... 312/223.1, 223.2, 312/223.3, 7.2, 324, 238; 52/36.1, 36.5, 65, 239

(56) References Cited

U.S. PATENT DOCUMENTS

| | | | | |
|---|---|---|---|---|
| 2,806,754 A | * | 9/1957 | Abeles et al. | 312/7.2 |
| 3,060,521 A | | 10/1962 | Greco | |
| 3,588,209 A | * | 6/1971 | Nathan | |
| 3,921,348 A | | 11/1975 | Kurzen | |
| 4,046,437 A | * | 9/1977 | Caron et al. | 312/196 X |
| 4,161,850 A | | 7/1979 | Peterson et al. | |
| 4,221,086 A | | 9/1980 | Berman | |
| 4,295,307 A | * | 10/1981 | Jensen | 52/236.1 |
| 4,332,113 A | | 6/1982 | Moore | |
| 4,395,856 A | | 8/1983 | Smith et al. | |
| 4,478,467 A | * | 10/1984 | Tyndall | 52/36.1 X |
| 4,932,172 A | | 6/1990 | Maas | |
| 5,009,042 A | | 4/1991 | Sacco et al. | |
| 5,072,999 A | * | 12/1991 | Trotta et al. | 52/36.1 X |
| 5,214,885 A | | 6/1993 | Maas et al. | |
| 5,282,341 A | | 2/1994 | Baloga et al. | |
| 5,394,658 A | | 3/1995 | Schreiner et al. | |
| 5,450,694 A | | 9/1995 | Goranson et al. | |
| 5,489,938 A | * | 2/1996 | Maruyama et al. | 312/223.3 X |
| 5,511,348 A | | 4/1996 | Cornell et al. | |
| 5,584,546 A | * | 12/1996 | Gurin et al. | 312/223.3 X |
| 5,651,219 A | * | 7/1997 | Baloga et al. | 52/36.1 X |
| 5,655,822 A | * | 8/1997 | Roberts et al. | 52/36.1 X |
| 5,675,946 A | | 10/1997 | Verbeek et al. | |
| 5,678,905 A | * | 10/1997 | Kelley | 312/326 X |
| 5,730,513 A | | 3/1998 | Lemon et al. | |
| 5,765,315 A | | 6/1998 | Nagamitsu et al. | |
| 5,806,248 A | * | 9/1998 | Kim | 52/36.1 |
| 5,829,202 A | | 11/1998 | Canton Gongora et al. | |
| 5,842,758 A | * | 12/1998 | Kelley | 312/196 |
| 5,996,287 A | | 12/1999 | Sullivan | |
| 6,003,275 A | | 12/1999 | Cornell et al. | |

FOREIGN PATENT DOCUMENTS

| | | | | |
|---|---|---|---|---|
| DE | 2262066 | | 6/1974 | |
| GB | 221441 | * | 9/1924 | 52/234 |
| JP | 3-33366 | | 2/1991 | |

* cited by examiner

*Primary Examiner*—Peter M. Cuomo
*Assistant Examiner*—Hanh V. Tran
(74) *Attorney, Agent, or Firm*—Foley & Lardner

(57) ABSTRACT

A media presentation system to present media in a work environment is provided. The work environment includes at least a first work space and a second work space and adapted for association with a frame system having a plurality of floorstanding posts and overhead beams. The media presentation system includes a first cabinet adapted to present media and situated in the first work space. The media presentation system also includes at least one articulating panel having a first and a second face. The articulating panel is adapted for mounting to the cabinet and for selective positioning between a first position and a second position. The articulating panel, when in the first position, conceals the media and the articulating partition, when in the second position, increases the relative level of privacy provided by the first work space.

44 Claims, 6 Drawing Sheets

MEDIA PRESENTATION SYSTEM

CROSS-REFERENCE TO RELATED APPLICATIONS

The following U.S. patent documents are cross-referenced and incorporated by reference: U.S. patent application Ser. No. 09/224,740 titled "WALL SYSTEM" filed December 31; and U.S. Pat. No. 5,511,348 titled "FURNITURE SYSTEM" issued Apr. 30, 1996 to Cornell et al.

FIELD OF THE INVENTION

The present invention relates to a media presentation system. More particularly, the present invention relates to a media presentation system having an articulating panel that may be selectively positioned to control access to media presented in a work environment.

BACKGROUND OF THE INVENTION

It is generally known to divide a space provided within a work environment into one or more work spaces. According to such known arrangements, the work spaces may be further divided or otherwise arranged to create one or more work areas for use by individual workers or groups of workers who may be engaged in individual or group activities, such as the presentation of media or other communication of information. For example, it is generally known to divide an "open plan" work environment into large work spaces (e.g., group meeting areas or "commons") and small work spaces (e.g., worker offices). It is also generally known to reconfigure such work areas within the work spaces by arrangement of one or more articles of furniture, such as panel walls, worksurfaces (e.g., display surfaces, tables, horizontal surfaces, vertical display boards), storage units (e.g., closets, cabinets, filing systems), chairs, seating products, etc. in a manner intended to support workers in a wide variety of individual and group activities. It is further generally known to provide systems for the presentation of media of a wide variety of formats (e.g., audio, visual, printed matter, etc.) in the work environment. For example, a work space may provide a projection screen, a television monitor, hanging display boards, etc.

According to known arrangements, a work environment may be divided (e.g., by fixed panel walls) into closed or private work spaces (e.g., worker offices) that provide privacy and security, as well as open or group work spaces that allow access or movement throughout the work spaces. However, if the work environment is divided into closed work spaces, such known arrangements may provide insufficient space for large group meetings or team interaction, for example, where media is to be presented. Further, if the work environment is divided into predominantly open work spaces, such known arrangements may provide insufficient space for private work, private meetings or secure work activities. Such known arrangements are not typically optimized for integration with systems for the presentation of media (particularly where the size of the group or level of desired privacy may be varied). For example, workers who desire to access media (e.g., participate in a teleconference or a videoconference) in an open work space may disrupt other workers who occupy the same or nearby work space, or may not be provided a suitable level of privacy (or freedom from distractions). Such known arrangements, therefore, may impose constraints on the range of activities and nature of media presentation that may efficiently be performed in the work environment.

The dynamic work environment, characterized by a need for flexibility, reconfigurable work areas and an ability to support a wide variety of activities of both individual workers and project teams of varying sizes, has recently grown in prevalence. The dynamic work environment typically includes mobile articles of furniture such as seating products, work surfaces and storage products. Individual and team spaces in the dynamic work environment are ideally capable of rapid configuration and reconfiguration by the workers themselves or by rearrangement of articles of furniture to support a variety of individual or group activities. However, such known systems for the presentation of media are typically not optimized for integration within the work space (e.g., facilitating space division) as needed to support particular activities involving the presentation of media, and therefore are not well-suited for use within the dynamic work environment.

Accordingly, it would be advantageous to provide for a system for the presentation of media in a work environment that is well-suited for use in a dynamic work environment and is adapted to be integrated within a work space of the work environment. It would also be advantageous to have a media presentation system adapted to selectively display or present media and to conceal the media and increase the relative level of privacy within a work space of the work environment without compromising performance. It would further be advantageous to provide for a media presentation system configured for the presentation of media that is adapted both to control access to the media and to control access to a work space (i.e., facilitating space division) within the work environment. It would further be advantageous to provide for a media presentation system that is adapted for use within a work space that substantially secures or conceals the media when in a "stowed" position and presents the media within the work space while at least partially concealing media from outside of the work space when in a "use" position.

SUMMARY OF THE INVENTION

The present invention relates to a media presentation system to present media in a work environment. The work environment includes at least a first work space and a second work space. The media presentation system is adapted for association with a frame system having a plurality of floor-standing posts and overhead beams. The media presentation system includes a first cabinet adapted to present media and situated in the first work space. The media presentation system also includes at least one articulating panel having a first and a second face. The articulating panel is adapted for mounting to the cabinet and for selective positioning between a first position and a second position. The articulating panel, when in the first position, conceals the media and the articulating partition, and when in the second position, increases the relative level of privacy provided by the first work space.

The present invention also relates to a media presentation system to present media in a work environment. The work environment provides at least a first work space and a second work space. The media presentation system is adapted for association with a frame system having a plurality of floor-standing posts and overhead beams. The media presentation system includes a first cabinet adapted to present media and situated in the first work space. The media presentation system also includes an articulating panel adapted for mounting to the cabinet and for selective positioning between a first position and a second position. The articulating panel when in the first position controls access to the media, and the articulating panel when in the second position at least partially controls access to the first work space.

The present invention further relates to a media presentation system to present media in a work environment. The work environment provides at least a first work space and a second work space. The media presentation system is adapted for association with a frame system having a plurality of floorstanding posts and overhead beams. The media presentation system includes a first cabinet adapted to present media and situated in the first work space. The media presentation system further includes two articulating panels adapted for mounting to the first cabinet and for selective positioning between a first position and a second position. The articulating panels, when in the first position, conceal the media relative to the first work space and the articulating panels, and when in the second position, conceal the media relative to the second work space.

DETAILED DESCRIPTION OF THE EXEMPLARY EMBODIMENTS

Referring to the FIGURES, a media presentation system adapted for use in a work environment is shown. According to preferred and other exemplary embodiments of the present invention, the work environment (i.e., any facility or environment for one or more workers) may include or be arranged to provide one or more work spaces for one or more workers. Each work space may be divided or otherwise arranged to provide one or more work areas for use by the workers, who may be engaged in any of a wide variety of individual activities or group activities, for example, as may be performed by members of a project team or department. Each work area may be configured to include one or more workstations according to preferred and other exemplary embodiments of the present invention. The workstations may be configured within a work area by including one or more articles of furniture intended to support the workers and their activities. As indicated in the FIGURES, the media presentation system is configured for use in association with work spaces and/or work areas in a variety of arrangements, each intended to support individual or collaborative activities of one or more workers.

According to a particularly preferred embodiment, the work environment is at least partially defined by architectural walls, a system of fixed or mobile panel walls, partial height partitions and stationary and mobile or articulating partitions. According to other preferred and alternative embodiments, the work environment and associated workstations may be arranged to include any of a wide variety of articles of furniture and other associated elements, including additional panel walls configured in any of a wide variety of orientations, space frames, chairs or other seating products, storage or casegoods products, tables and other worksurfaces, lighting products or systems, as well as other accessories, electronic or computing equipment and other systems (with associated connectivity such as cabling) known and used in the work environment.

Figure 1A:
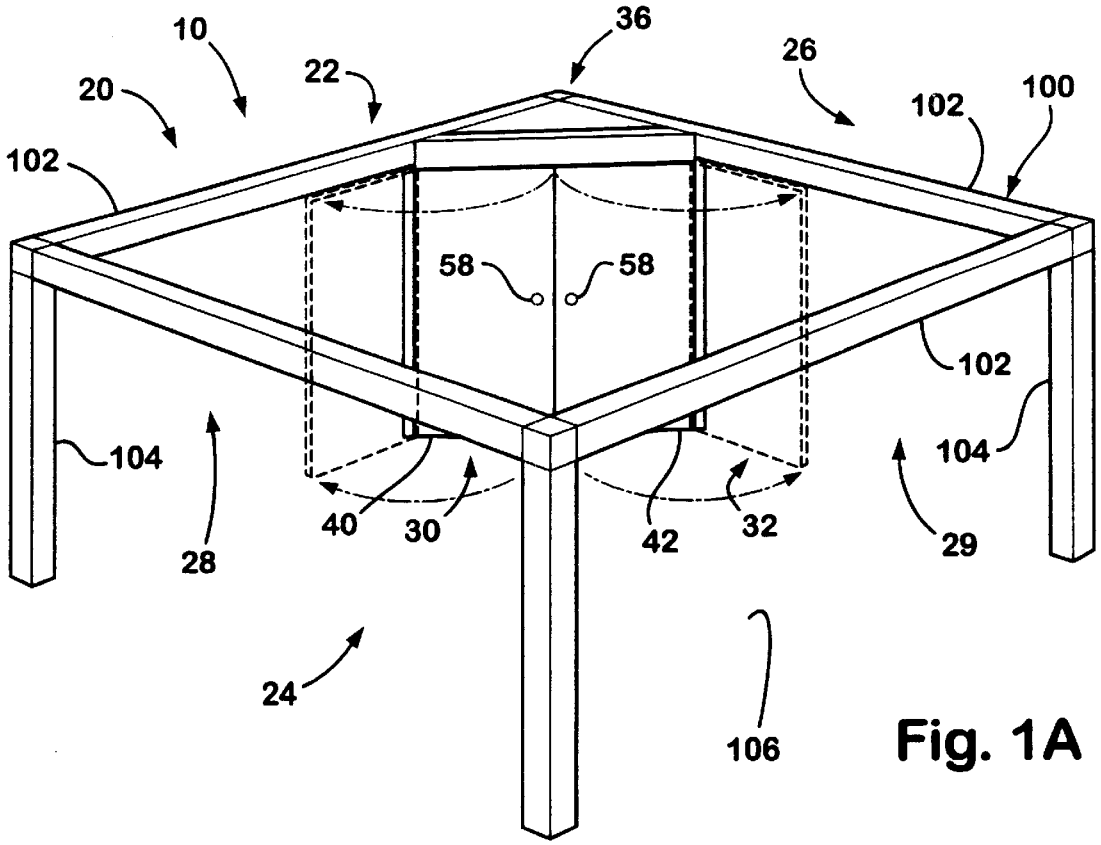
FIG. 1A is a perspective view of a media presentation system to present media in a work environment according to an exemplary embodiment of the present invention.

Referring to FIG. 1A, a media presentation system 10 configured to present media in a work environment 20 is shown according to an exemplary embodiment of the present invention. A frame system 100 of work environment 20 defines work space 22. Frame system 100 further defines a small group work area 24 and a large group work area 26 within work space 22. Frame system 100 includes structural members shown as overhead horizontal beams 102 and floorstanding vertical posts 104. Frame system 100 also defines openings (e.g., entranceway or doorway) for ingress and egress (shown as a portal 28 and a portal 29). Work space 22 may be provided with other partitions (e.g., fixed, mobile, partial height wall, hanging, etc.) for example shown in FIG. 7 as a flexible partition (shown as a curtain 60) and a display board 64 that may divide work environment 20 into work spaces of varying sizes or configurations. According to alternative embodiments shown in the FIGURES, the media presentation system may include a top portion attached to the horizontal beam that extends upwardly above the frame system; the partitions may be constructed from a flexible material, such as vinyl.

The frame system can be formed from structural members installed in the work environment to define the work spaces. According to a particularly preferred embodiment, the structural members of the frame system may have a substantially square, hollow, cross-sectional configuration that facilitates the routing of various utilities (e.g., power wires, signal wires, lighting wires, etc.) to the work environment, such as the frame system disclosed in U.S. Pat. No. 5,511,348 titled "FURNITURE SYSTEM" issued Apr. 30, 1996 to Cornell et al. and incorporated by reference herein.

Figure 2A:
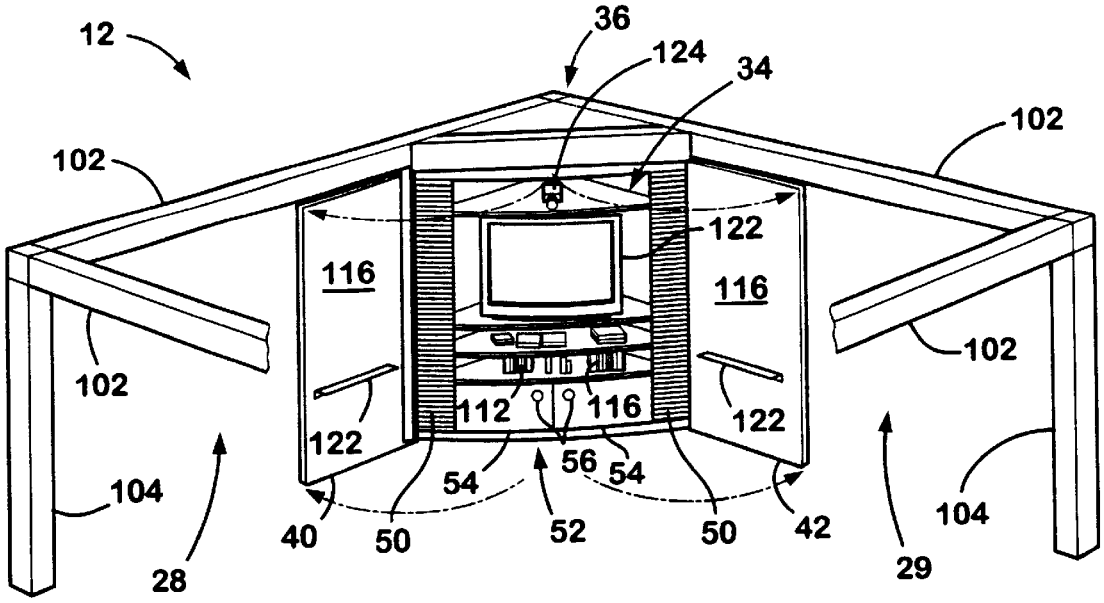
FIG. 2A is a fragmentary perspective view of a media presentation system to present media in a work environment showing each articulating panel in an opened position according to an exemplary embodiment of the present invention.
Figure 2B:
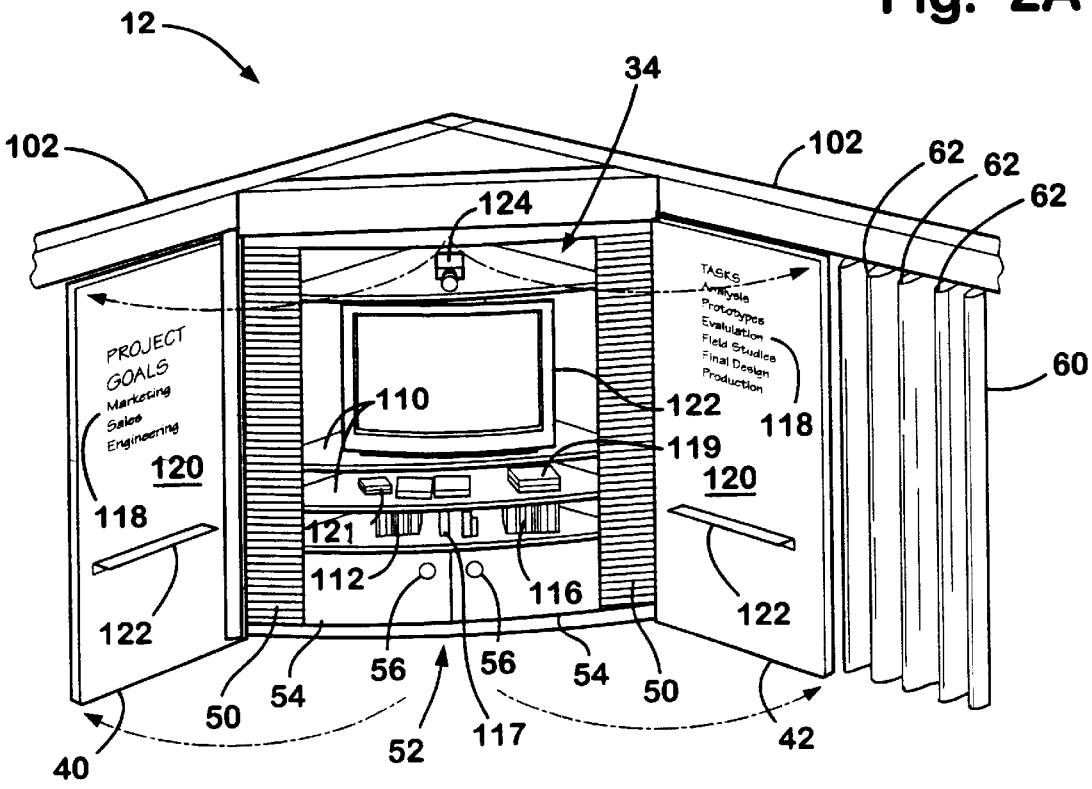
FIG. 2B is fragmentary perspective view of the media presentation system of FIG. 2A showing a flexible partition.
Figure 3:
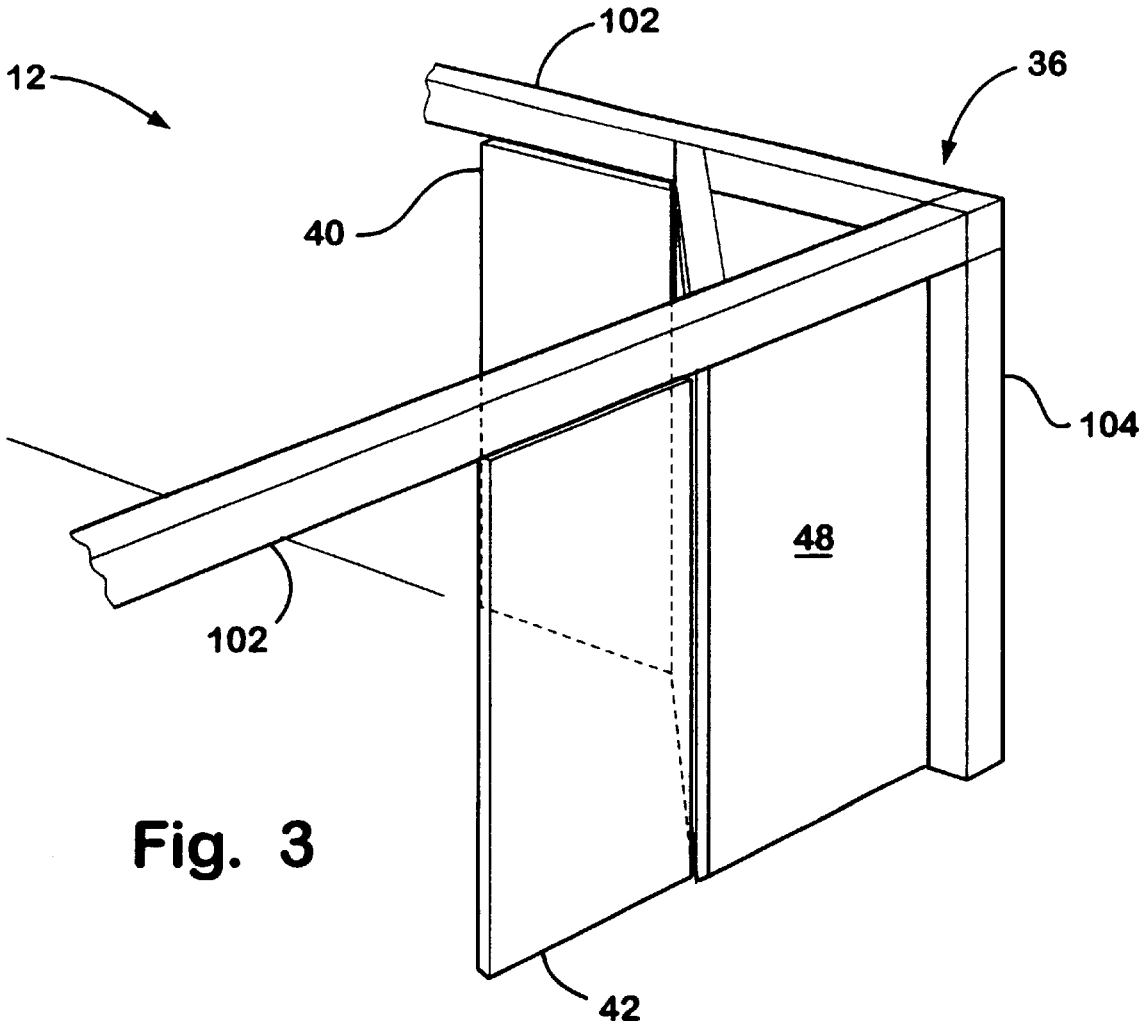
FIG. 3 is a fragmentary perspective view of the media presentation system of FIG. 2A showing each articulating panel in an opened position.
Figure 4:
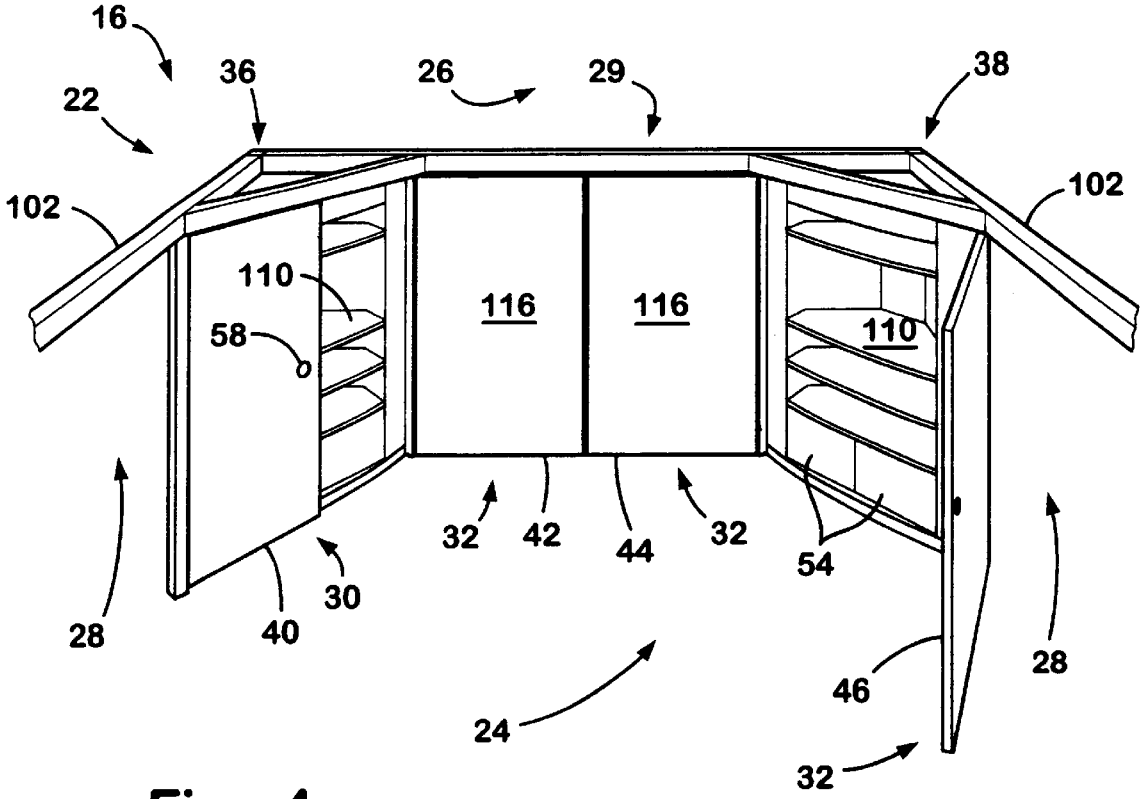
FIG. 4 is a fragmentary perspective view of a media presentation system to present media in a work environment according to an exemplary embodiment of the present invention.

System 10, which is integrated within work area 24 of work environment 20, includes a left cabinet 36 having a cavity 34. Panel doors, shown as a left articulating panel 40 and a right articulating panel 42, are attached to the edges of cabinet 36 by a pivot mechanism (shown in FIG. 9 as a hinge 70). According to any preferred embodiment, each panel is pivotally mounted to the cabinet by the pivot mechanism such that each panel pivots or swings about the edge of the cabinet. As shown in FIGS. 1A through 7, left and right articulating partitions 40 and 42 are adapted for selective positioning between a "stowed" position (shown as fully closed position 30 relative to work area 24) and a "use" position (shown as fully opened position 32 relative to work area 24). Cabinet 36 is situated in the corner of work area 24 and is supported in part by a floor 106. Referring to FIG. 4, a media presentation system 16 configured to present media in work environment 20 is shown according to an exemplary embodiment of the present invention. System 16 includes left cabinet 36 and a right cabinet 38. Right cabinet 38 includes a left articulating panel 44 and a right articulating panel 46.

Figure 1B:
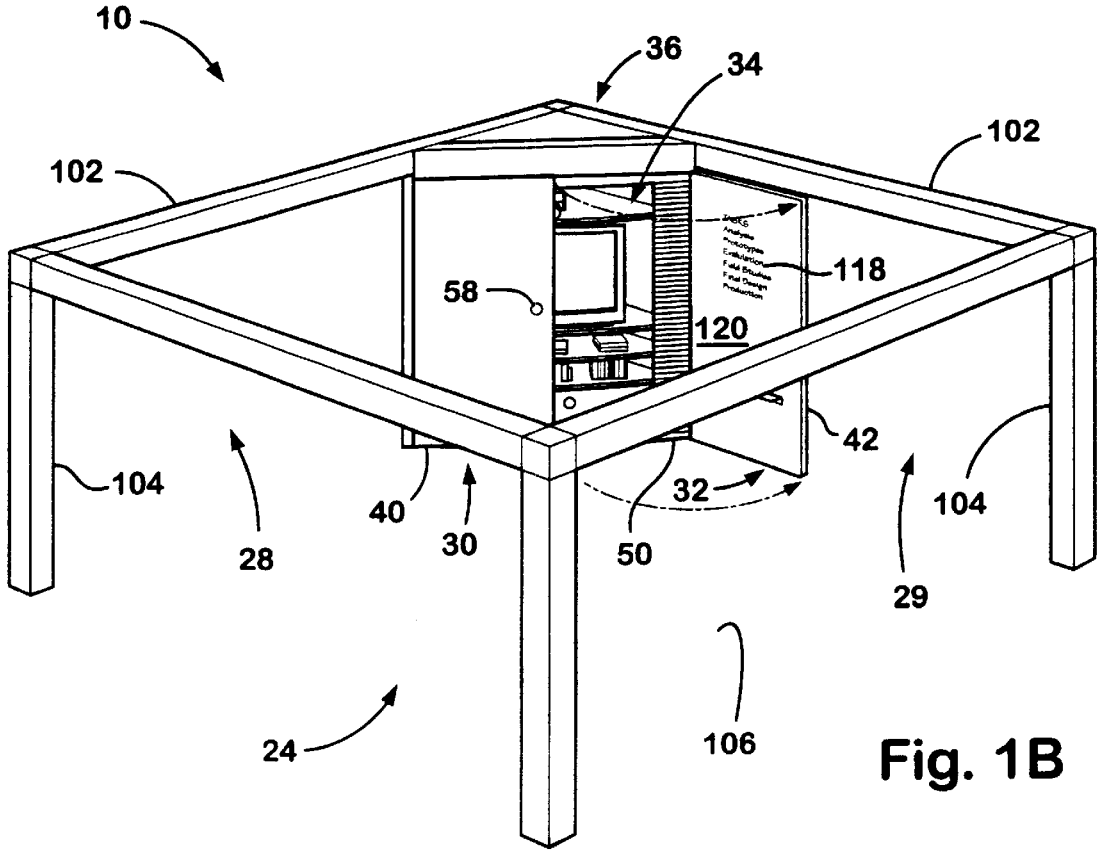
FIG. 1B is a perspective view of the media presentation system of FIG. 1A showing one articulating panel in an opened position.

System 10 may present and conceal media and associated technology stored in cavity 34. As shown in FIG. 2A, media stored in cavity 34 of cabinet 36 may be displayed to a worker situated in work area 24. For example, a worker situated in work area 24 may view media either presented on a video monitor 123 stored in cavity 34 or displayed on the face (e.g., interior or exterior) of left and right articulating panels 40 and 42 (shown as text 118). According to alternative embodiments, the articulating panels of two cabinets may be used in combination to display media by aligning the panels of the two adjacent cabinets. As shown in FIG. 4, when right articulating panel 42 of left cabinet 36 and left articulating panel 44 of right cabinet 38 are positioned in opened position 32, portal 29 is completely obstructed. In this configuration of system 16, the faces of right articulating panel 42 of left cabinet 36 and left articulating panel 44 of right cabinet 38 may be aligned to display information, such as projected media, elongate banners, posters, etc. Referring to FIG. 1B, system 10 is shown with right articulating panel 42 in opened position 32 and left articulating panel 40 in closed position 30. When either left or right articulating partitions 40 and 42 are positioned in opened position 32, cavity 34 of cabinet 36 is exposed. Cavity 34 may include a vertical storage compartment 50 to store supplies or other items such as compact discs, laser discs, digital video discs, video and tape cassettes, periodicals, etc. that support worker activity, or particularly, the presentation of media. Cavity 34 may also include includes shelves (shown as horizontal shelves 110), such as vertical shelves, to support small items (shown as a magazine 112, a book 114, a video cassette 117, a tape cassette 115, a pad 119 and a tablet 121) such as knick-knacks, vases, framed pictures, etc. Horizontal shelves 110 may also support items (shown as monitor 123 and a camera 124) to present and display media and to access technology. According to alternative embodiments (as shown in FIG. 2B), cabinet 36 may include secondary a housings (shown as a housing 52) to store large items such as periodicals, files, computers, etc. Housing 52 may include doors 54 pivotally connected to the edge of housing 52 and a handle 56 mounted to the face of doors 54. According to a preferred embodiment (as shown in the FIGURES), left and right articulating partitions 40 and 42 conceal cavity 34 of cabinet 36 when in closed position 30 and control access to work area 24 by obstructing ingress and egress through portals 28 and 29 when in opened position 32.

Figure 5:
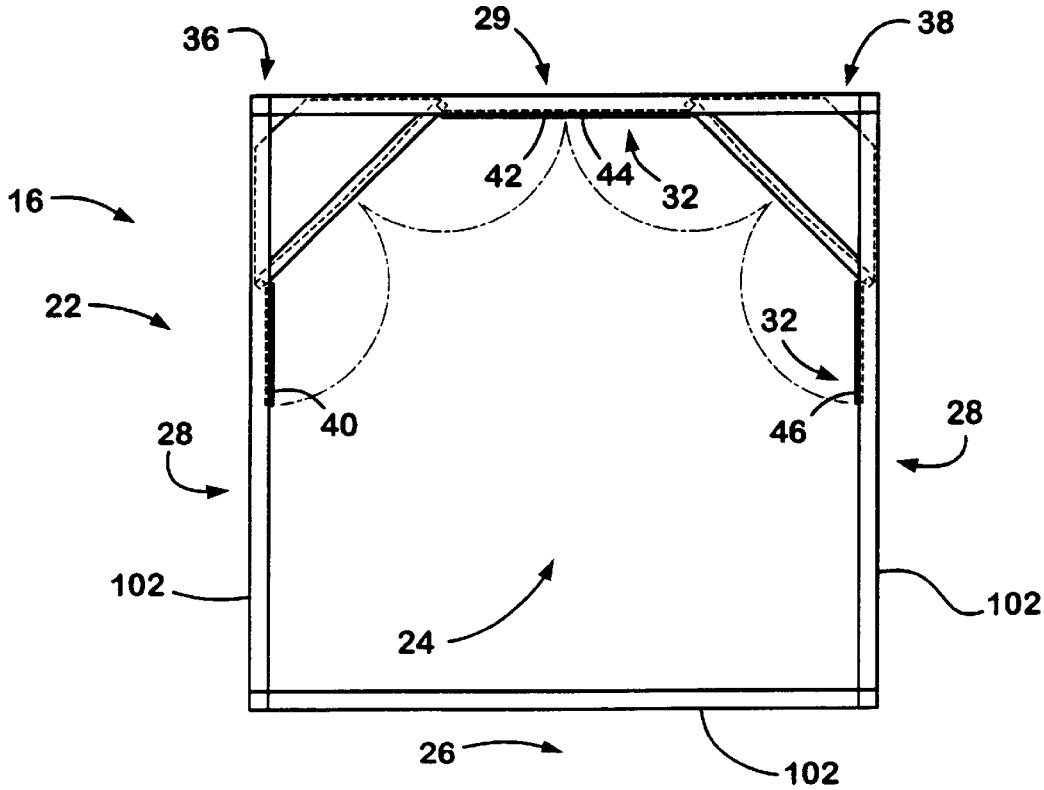
FIG. 5 is a top plan view of the media presentation system of FIG. 4 showing each articulating panel in an opened position.
Figure 6:
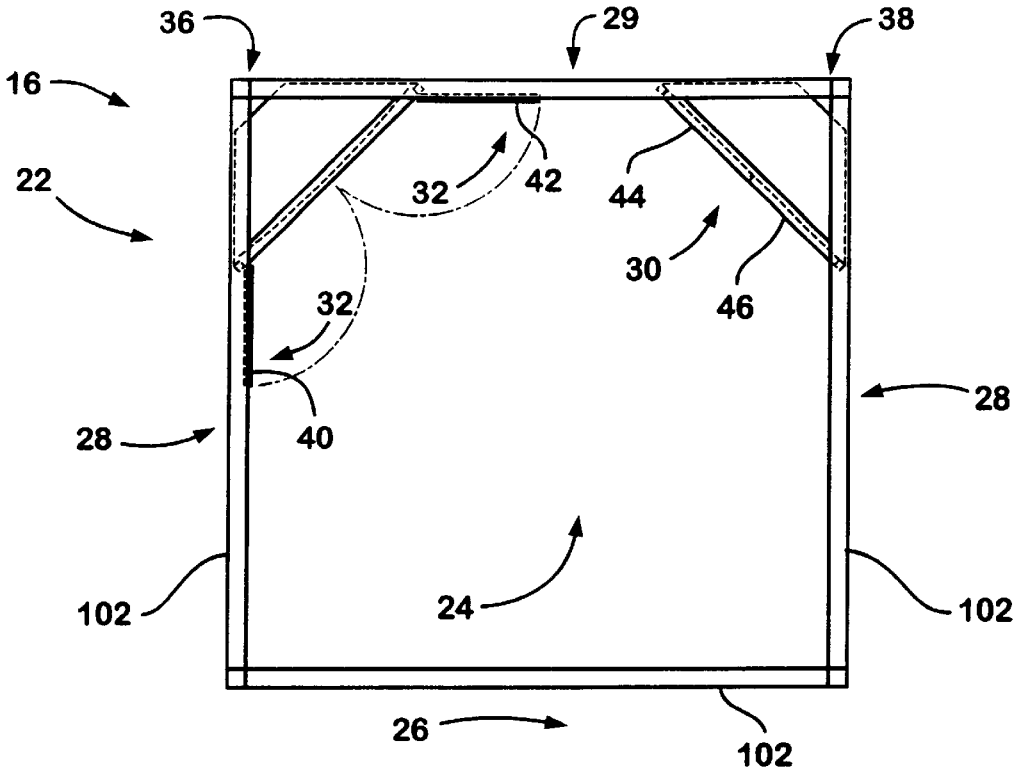
FIG. 6 is a top plan view of the media presentation system of FIG. 4 showing each articulating panel of one cabinet in an opened position.
Figure 7:
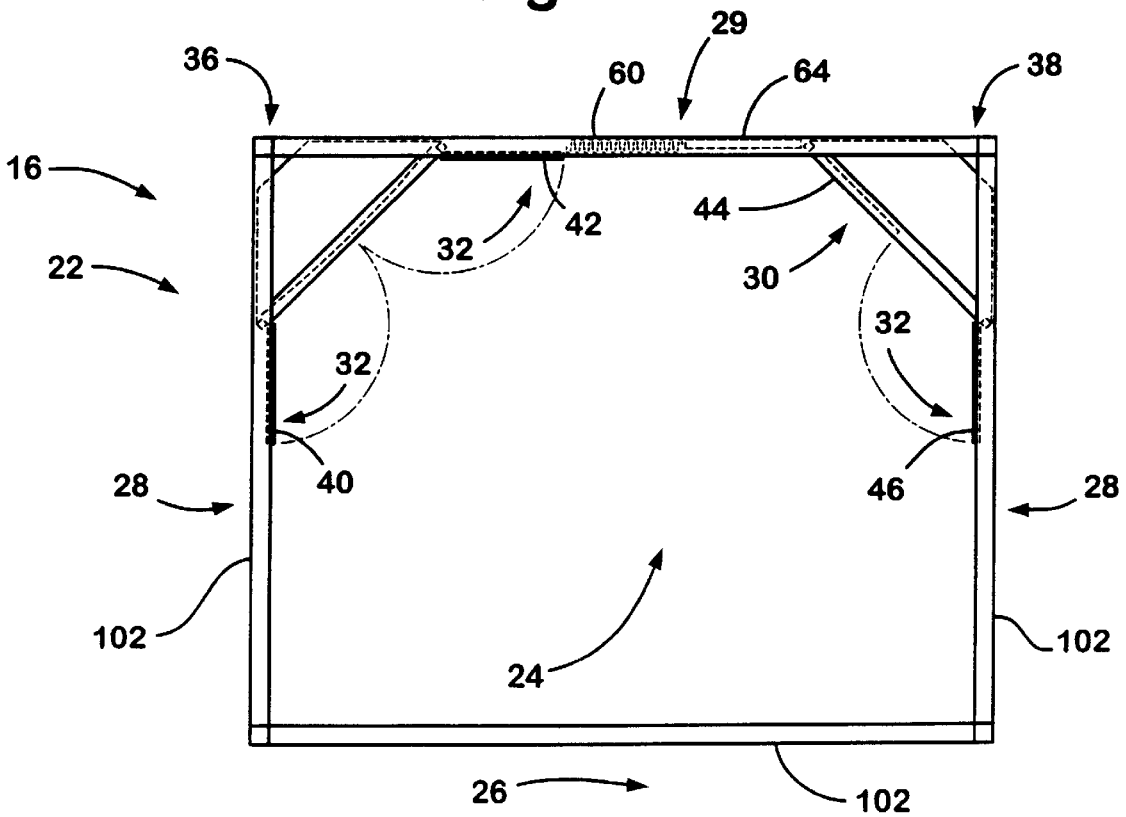
FIG. 7 is a top plan view of the media presentation system of FIG. 4 showing an articulating panel, a flexible partition and a display board.

According to any preferred embodiment, the media presentation system may be used to selectively reconfigure, divide and partition the work spaces provided in the work environment to support individual workers and groups of workers in various activities. The media presentation system may be initially configured when installed in the work environment, and the articulating panels may be selectively positioned to reconfigure the work spaces for worker activities or the presentation of media. As shown in FIG. 5, work space 22 assumes a first plan configuration when right articulating panel 42 of left cabinet 36 is configured in opened position 32 and left articulating panel 44 of right cabinet 38 is configured in opened position 32; as shown in FIG. 6, work space 22 assumes a second plan configuration when left and right articulating panels 40 and 42 of left cabinet 36 are configured in opened position 32 and left and right articulating panels 44 and 46 of right cabinet 38 are configured in closed position 30; as shown in FIG. 7, work space 22 assumes a third plan configuration when left and right articulating panels 40 and 42 of left cabinet 36 are configured in opened position 32, left articulating panel 44 of right cabinet 38 is configured in closed position 30, flexible partition 60 is partially extended across portal 29 and display board 64 is hung from horizontal beam 102 of frame 100. These plan configurations of work space 22 serve to reconfigure and divide the space between work area 24 and work area 26 for the effective viewing and presentation of media and access to technology.

The space available or open to a worker situated in work area 24 or work area 26 varies according to the configuration of work space 22. For example, when left and right articulating panels 40 and 42 are positioned in closed position 30 the amount of space open to a worker situated in work area 24 is maximized for collaborative worker activities, because the worker situated in work area 24 has access to the space of both work area 24 and work area 26 (see, e.g., FIG. 1A). Further, when system 16 is configured as in FIG. 6, the space of work area 26 is open to workers situated in work area 24 (or vice versa), because workers can enter and exit work areas 24 and 26 through portal 29. However, when work space 22 is configured as in FIGS. 5 and 7, the space of work area 26 is inaccessible to workers situated in work area 24 (or vice versa) through portal 29, which is partially obstructed by a combination of articulating panels, flexible partitions and display boards. When work space 22 is configured as in FIGS. 5 and 7, work area 24 is well suited for the viewing and presentation of media or for worker activities. Hence, while the total amount of space in work space 22 remains constant, the amount of space that is dedicated to collaborative worker activities for the viewing and presentation of media varies depending on the workers' needs and the selective positioning of the articulating panels.

The media presentation system may be reconfigured to control worker movement within the work environment by varying the position of the articulating panels, flexible partitions and display boards. System 16 (as shown in FIG. 5) is configured so that each articulating panel is positioned in opened position 32. In this configuration of system 16, the articulating panels control ingress and egress through portal 29. System 16 (as shown in FIG. 6) is configured so that only right articulating panel 42 of left cabinet 36 obstructs portal 29. Thus, ingress and egress by workers through portal 29 is less obstructed than is the ingress and egress through portal 29 when system 16 is configured as shown in FIG. 5. Further, the media presentation system can be reconfigured to control worker access to the media presented within the work environment by varying the position of the articulating panels, flexible partitions and display boards. For example, when left and right articulating panels 40 and 42 are positioned in opened position 32, a worker situated in work area 24 may effectively view any media presented by system 10 (see FIG. 1A). However, when left and right articulating panels 40 and 42 are positioned in opened position 32, left and right articulating panels 40 and 42 at least partially conceal the media presented to a worker situated in work area 26. Moreover, as shown in FIG. 4, left and right articulating panels 40 and 42 may secure (e.g., circumscribe or enclose) work area 24 when in opened position 32 (i.e., work area 24 is substantially inaccessible to a worker situated in work area 26).

A worker can achieve the relative level of privacy desired between access or openness (interaction) and privacy or security (isolation) by positioning any articulating panel of any cabinet (or associated flexible partition, panel or display board). For example, system 16 (as configured in FIG. 4) offers a level of privacy suited to the "private" viewing and presentation of media in work area 24, because portal 29 is obstructed by articulating panels 42 and 44 to shield and direct the attention of a worker in work area 24 to the media presented (while at least partially blocking the media from others). System 10 (as configured in FIG. 1A) offers a level of privacy more suited to the casual or intermittent viewing and presentation of media than that offered by system 16 (as configured in FIG. 5), because workers can enter and exit interior work area 24 through portal 29 during the presentation. Hence, the selective positioning of the articulating panels controls worker movement in and around the work space, focuses a worker's attention on the media presented, and varies the relative level of privacy (auditory and visual) offered by the media presentation system for the viewing and presentation of media and accessing of technology selectively as called for by the workers.

Referring to FIG. 2A, left and right articulating panels 40 and 42 are shown according to an exemplary embodiment of the present invention. Left and right articulating panels 40 and 42 are essentially planar. Handle 58 is mounted to the face of left and right articulating panels 40 and 42. Handle 58 aids in the selective positioning of left and right articulating panels 40 and 42 between closed position 30 and opened position 32.

According to a particularly preferred embodiment, cabinet 36 is constructed of wood and left and right articulating panels 40 and 42 are constructed of wood. Left and right articulating panels 40 and 42 are provided with a whiteboard surface treatment on the interior face and a paint surface treatment on the exterior face. According to a particularly preferred embodiment, the articulating panels have a wood core. According to other preferred embodiments, the articulating panels may be constructed with a shell or core made of wood, aluminum, plastic, fiber, cardboard, acoustic dampeners or a variety of substantially rigid materials in a variety of structures (e.g., solid, layered, honeycomb, etc.) known in the art. According to alternative embodiments, the articulating panels may be translucent, clear, opaque or provided with a light source or have any of a variety of other constructions.

Figure 8:
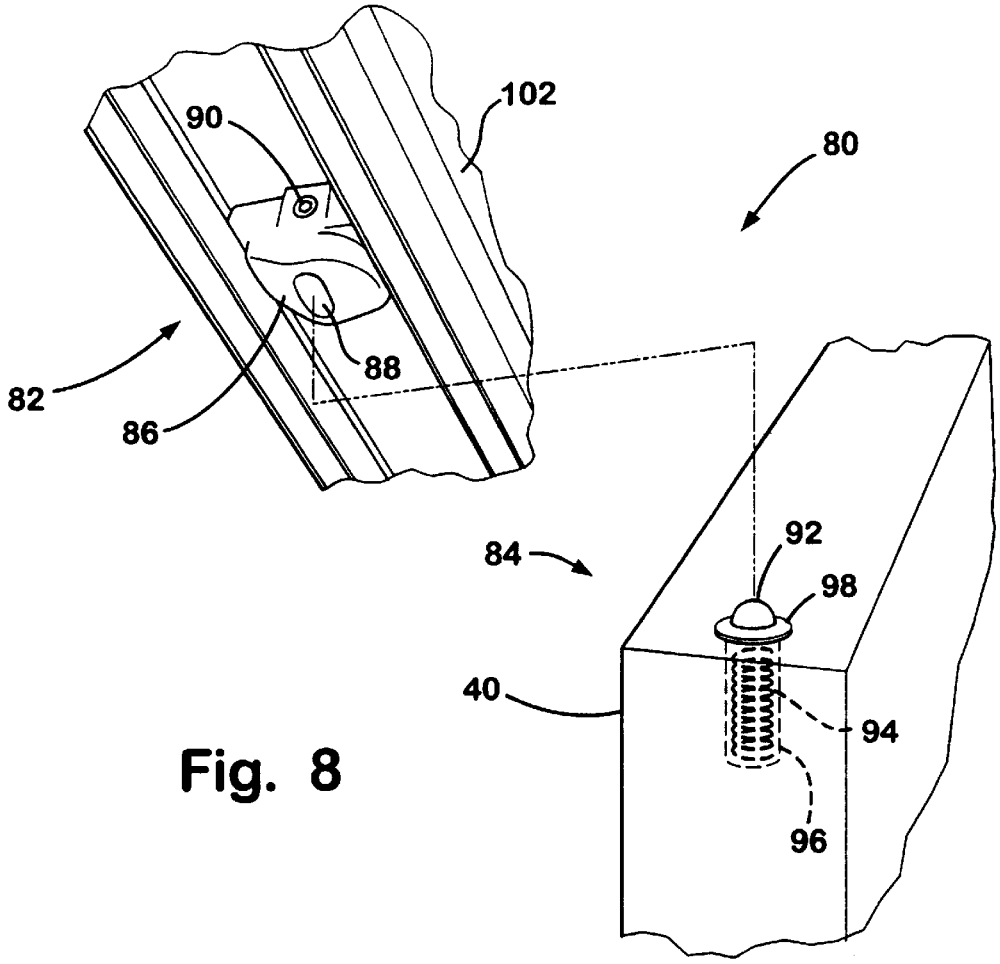
FIG. 8 is an exploded fragmentary perspective view of a locking mechanism according to an exemplary embodiment of the present invention.

Referring to FIG. 8, a locking mechanism 80 of system 10 is shown according to an exemplary embodiment of the present invention. Locking mechanism 80 fixes left and right articulating panels 40 and 42 in closed position 30 and opened position 32. Locking mechanism 80 includes a stop mechanism 82 and a detent mechanism 84. Stop mechanism 82 is attached to a mounting structure 86 by a fastener (e.g., adhesive). Mounting structure 86 is attached to the bottom of horizontal beam 102 by a fastener (shown as a screw 90). Stop mechanism 82 includes a stopper cavity 88. When left and right articulating panels 40 and 42 are positioned in either closed position 30 or opened position 32, stop mechanism 82 engages detent mechanism 84 to impede left and right articulating panels 40 and 42 from extending beyond stop mechanism 82 (as shown in FIG. 2A and 2B). Detent mechanism 84 is attached to the top edge of left and right articulating panels 40 and 42. Detent mechanism 84 includes a finger 92 retractably mounted to the top edge of left and right articulating panels 40 and 42. Finger 92 engages a bias mechanism (shown as a spring 94) so that finger 92 is retractable into a panel cavity 96 of the top edge of left and right articulating panels 40 and 42. When left and right articulating panels 40 and 42 are in closed position 30 or opened position 32, finger 92 of detent mechanism 84 extends into stopper cavity 88. When it is desired to position left and right articulating panels 40 and 42 away from closed position 30 or opened position 32, the application of a slight force on handle 58 causes finger 92 to retract out of stopper cavity 88 so that detent mechanism 84 completes its engagement with stop mechanism 82. According to an alternative embodiment, the mounting structure is height adjustable. According to a preferred embodiment, the stop mechanism is made of a substantially rigid material, such as rubber or plastic. According to a preferred embodiment (as shown in FIG. 8), an extrusion 98 is fixedly mounted to the top edge of left and right articulating panels 40 and 42, circumscribes finger 92, and increases in height from the top edge of the articulating panels to about the middle of finger 92 when finger is not retracted into partition cavity 96.

Figure 9:
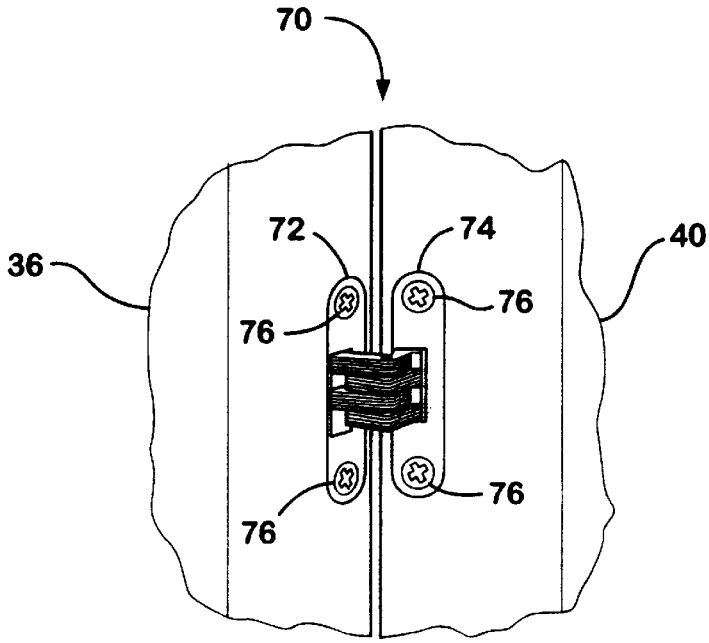
FIG. 9 is a fragmentary perspective view of a pivot mechanism according to an exemplary embodiment of the present invention.

FIG. 9 shows a pivot mechanism (shown as a hinge 70) of system 10 according to an exemplary embodiment of the present invention. Left and right articulating panels 40 and 42 are mounted to cabinet 36 by hinge 70. The pivot mechanism, in part, supports the articulating panels. A left portion 72 of hinge 70 is fastened to the vertical edge of cabinet 36 by fasteners (shown as screws 76) and a right portion 74 of hinge 70 is fastened to right articulating panel 42 by screws 76. According to any preferred or alternative embodiments, the pivot mechanism may be any type of structure (e.g., hinge, glide, hook arrangement, etc.) that permits the articulating partition to pivot or swing about the cabinet. According to an alternative embodiment (as shown in FIG. 3), left and right articulating panels 40 and 42 may pivot about cabinet 36 so that left and right articulating panels 40 and 42 are parallel with associated horizontal beam 102 and a face 48 of cabinet 36, respectively. According to other alternative embodiments of the present invention, the articulating panels may pivot about the vertical edge of the cabinet by approximately 270 degrees, such that the face of the articulating panels are adjacent and parallel to the associated faces of the cabinet. According to a preferred embodiment, the hinge is hidden from view when left and right articulating panels are positioned in the closed position.

According to an alternative embodiment, a wheel assembly may support the articulating panels. The wheel assembly may include a caster rotably mounted to the bottom of the articulating panels and engages the floor. According to other alternative embodiments, the wheel assembly may be provided with a brake mechanism to restrict the movement of the articulating panels on the floor. According to still other alternative embodiments, the wheel assembly may be provided with a shock or height adjustment mechanism to vary the distance between the bottom of the articulating panels and any uneven portions of the floor.

The articulating panels may be provided with one or more accessories, which may be accessible from either face (e.g. interior or exterior) of the articulating partition, suited for a particular application. Referring to FIG. 2A, the face of left articulating panel 40 includes an accessory (shown as a tray 122) such as a receptacle for supporting items (e.g., markers, pens, display boards, etc.). The face of right articulating panel 42 is provided with a worksurface 117. Information and data (shown as text 118), such as stationary images, projected images, graphs, writing, etc., may be presented on worksurface 117. Either face of each articulating panel may have a functional and/or decorative use (e.g., display capabilities such as a tackable surface and/or marker board, electronic displays, reflective projector screens or like activities) to more effectively support worker activities in the work environment. According to an alternative embodiment (as shown in FIG. 2A), a decorative or functional surface treatment (shown as a dry-erase "white" board 120) or a covering fabric may be associated with left and right articulating panels 40 and 42. According to a preferred and other alternative exemplary embodiments of the present invention, the decorative or functional surface treatments applied to the panels (or other associated structures of the media presentation system) may include, for example, a tackable or repositionable adhesive, clear overlay, writable clear film, cork or tack board, peg board, magnetic board, marker board, dry erase or "white" board, blackboard, paper or paper tablet, projection screen, graphics display, cloth, metal, laminate, veneer, painted surface, fabric, etc. to more effectively support worker activities within the work environment in a wide variety of combinations (i.e., with one surface differing in whole or in part from the other surface) that may be suited or adapted to a wide variety of functional or decorative purposes.

According to a particularly preferred embodiment, the cabinet has a trapezoid shape when the articulating panels are in the closed position. The cabinet is sized to accommodate media and associated technology for displaying media. The cabinet is constructed of wood. The exterior of the cabinet is provided with a paint surface treatment. The articulating panels are offset from the edge of the cabinet. The interior faces of the articulating panels are provided with a whiteboard surface treatment, and include a tray for holding markers and erasers. The interior of the cabinet includes a lower housing having doors constructed of wood and having a varnish surface treatment. The interior of the cabinet also includes four horizontal shelves constructed of wood that are provided with a painted surface treatment. The horizontal shelves provide a surface for storing items and are spaced apart to accommodate media such as books and videos. Two of the shelves are spaced apart to accommodate a video monitor. A decorative member having horizontal striations extends from the top of the lower housing to the top of the cabinet.

It is important to note that the term "media" is not meant as a term of limitation, insofar as any "media" or like manner of communication, including but not limited to audio, visual or video, audio-visual, printed or written matter, telephony, computer graphics, etc., is intended to be within the scope of the term. The use of the term "media" is intended as a convenient reference for any such media or associated structure or technology used to access, present, record, display or view the associated media in any format, or presented by any type of device, system, or equipment, such as a sound system, intercom, telephone, television, video monitor, computer, whiteboard, tablet, etc., or other formats. Further, the use of the term "media" is meant to include any use of any type of information that can be associated with a worksurface.

Although only a few exemplary embodiments of the present invention have been described in detail in this disclosure, those skilled in the art who review this disclosure will readily appreciate that many modifications are possible in the exemplary embodiments (such as variations in sizes structures, shapes and proportions of the various elements, values of parameters, mounting arrangements, locking mechanisms, configurations of the work environment, or use of materials) without materially departing from the novel teachings and advantages of the invention. As will be understood by those who review this disclosure, according to the preferred and alternative embodiments, the elements associated with the media presentation system (such as frames, cabinets, panels, equipment) may be installed and configured (e.g., sized, shaped, positioned, etc.) within the work environment in a variety of arrangements, intended as necessary in a particular application (or set of applications) to facilitate the creation of any number of small group work spaces or large group work spaces. Many configurations of the work environment (such as those shown in, but not limited to, the FIGURES) are possible and within the scope of the present invention. Any number of cabinets may be positioned at any of a variety of locations within the work environment (which may be provided with any number of openings for ingress and egress). According to alternative embodiments, the articulating panels may pivot about the top and bottom edges of the cabinet. Still further, according to other alternative embodiments of the present invention, the articulating panels may slide horizontally with respect to the cavity of the cabinet and pivot about the cabinet between an opened and closed position. The size or shape (or interior) of each cabinet may vary as required for a particular application or type (or types or format) of media to be presented. Accordingly, all such modifications and variations are intended to be included within the scope of the invention as defined in the appended claims. Other substitutions, modifications, changes or omissions may be made in the design, operating conditions or arrangement of the exemplary, alternative or preferred embodiments without departing from the spirit of the invention as expressed in the appended claims.

What is claimed is:

1. A presentation system selectively configurable to present media in a work environment including at least a first work space and a second work space comprising:

a frame system having a plurality of vertical floorstanding posts and horizontal overhead beams;

at least one cabinet adapted to present media and situated in the first work space;

at least one articulating partition adapted for mounting to the cabinet and for selective positioning between a first position and a second position, wherein the articulating partition when in the first position at least partially limits access to the media and the articulating partition when in the second position at least partially limits access to the first work space and is configured to engage at least one of the overhead horizontal beams.

2. The presentation system of claim 1 wherein the partition in the second position is in an opened position.

3. The presentation of claim 1 wherein the partition in the second position divides the first work space and the second work space.

4. The presentation system of claim 1 wherein the partition in the second position directs a viewer's attention to the media.

5. The presentation system of claim 1 wherein the partition in the first position provides a worker access to the first work space and the second work space and the partition in the second position controls movement of the worker between the first work space and the second work space in the work environment.

6. The presentation system of claim 1 wherein the partition conceals the media when in the first position and reveals the media when in the second position.

7. The presentation system of claim 1 further comprising at least one accessory mounted to the partition.

8. A presentation system selectively configurable to present media in a work environment comprising:

an open frame system including a plurality of generally vertical floorstanding posts and a plurality of generally horizontal overhead beams, wherein the intersection of at least two beams provides a corner;

a portal within the frame system for ingress and egress between a first work space within the frame system adjacent a second work space;

at least one cabinet adapted to present media situated in the corner of the first work space;

two panels coupled to the at least one cabinet for pivotal movement between a first position and a second position;

wherein the panels in the first position conceal the media relative to the first work space, and the panels in the second position conceal the media relative to the second work space and are configured to engage at least one beam.

9. The presentation system of claim 8 wherein the panels have a height substantially the same as a height of at least one beam.

10. The presentation system of claim 8 wherein at least one of the panels in the second position at least partially divides the first work space and the second work space.

11. The presentation system of claim 8 wherein the panels when in the second position are configured to register with at least one beam.

12. The presentation system of claim 8 wherein the panels when in the first position provide access to the first work space.

13. The presentation system of claim 8 wherein the panels when in the second position at least partially restrict movement of a worker between the first work space and the second work space.

14. The presentation system of claim 8 wherein the panels when in the first position conceal the media within an interior of the cabinet and when in the second position expose the interior of the cabinet.

15. The presentation system of claim 14 further comprising at least one accessory mounted to at least one of the panels.

16. The presentation system of claim 15 wherein the cabinet includes at least one interior space.

17. The presentation system of claim 16 wherein the cabinet includes a surface treatment.

18. The presentation system of claim 16 wherein the panels in the second position at least partially restrict access through the portal.

19. The presentation system of claim 18 wherein the panels in the second position are generally parallel to at least one beam.

20. The presentation system of claim 19 wherein the posts are freestanding.

21. The presentation system of claim 20 wherein at least one of the panels in the second position is configured to intersect at least one beam.

22. A media presentation system selectively configurable to present media in a work environment providing at least a first work space and a second work space comprising:

a frame system having a plurality of freestanding floor supported posts and a plurality of generally horizontal overhead beams;

a cabinet adapted to present media situated in the first work space;

at least one panel coupled to the cabinet for articulation from a first position to a second position relative to the cabinet and configured to engage at least one beam whereby the at least one panel is generally parallel to the at least one beam;

wherein the panel when in the first position conceals the media, and the panel when in the second position at least partially separates the first work space and the second work space.

23. The media presentation system of claim 22 wherein the panel when in the first position conceals the media.

24. The media presentation system of claim 23 wherein the panel in the second position is configured to at least partially intersect at least one beam.

25. The media presentation system of claim 23 wherein the panel in the second position is configured to register with at least one beam.

26. The media presentation system of claim 25 wherein the second position is disposed between the first position and a third position in the second work space.

27. The media presentation system of claim 26 wherein the third position is at least about 270 degrees from the first position.

28. The media presentation system of claim 26 wherein the at least one panel is configured to intersect at least one beam.

29. The media presentation system of claim 27 wherein the panel when in the second position at least partially directs attention to the media.

30. The media presentation system of claim 27 wherein the panel when in the first position conceals the media and allows generally unrestricted access to the first work space.

31. The media presentation system of claim 27 wherein the panel when in the second position at least partially controls movement of a worker between the first work space and the second work space.

32. The media presentation system of claim 27 wherein the panel is pivotally coupled to the cabinet.

33. The media presentation system of claim 32 wherein the panel comprises a door.

34. The media presentation system of claim 32 further comprising a second cabinet situated in the first work space adapted to present media.

35. The media presentation system of claim 32 further comprising at least one of a video system, an audio system, and combinations thereof, disposed within the cabinet.

36. The media presentation system of claim 33 further comprising a hinge to attach the panel to the cabinet.

37. The media presentation system of claim 36 further comprising at least one accessory mounted to the panel.

38. The media presentation system of claim 37 wherein the accessory comprises a handle.

39. The media presentation system of claim 37 wherein the panel includes a surface treatment.

40. The media presentation system of claim 37 wherein the panel has an interior surface and a surface treatment is provided on the interior surface of the panel.

41. The media presentation system of claim 40 wherein the surface treatment is a marker board.

42. The media presentation system of claim 41 wherein the panel presents a surface configured to present a video display.

43. The media presentation system of claim 41 wherein the cabinet includes a teleconferencing device.

44. The presentation system of claim 8 wherein the at least two beams intersect at about 90 degrees to provide the corner.

* * * * *